US006797948B1

(12) United States Patent
Wang

(10) Patent No.: US 6,797,948 B1
(45) Date of Patent: Sep. 28, 2004

(54) MULTIPOLE ION GUIDE

(75) Inventor: Houle Wang, Billerica, MA (US)

(73) Assignee: Bruker Daltonics, Inc., Billerica, MA (US)

( * ) Notice: Subject to any disclaimer, the term of this patent is extended or adjusted under 35 U.S.C. 154(b) by 0 days.

(21) Appl. No.: 09/636,321

(22) Filed: Aug. 10, 2000

(51) Int. Cl.[7] ..... H01J 49/42
(52) U.S. Cl. ..... 250/292; 250/288
(58) Field of Search ..... 250/292, 288

(56) References Cited

U.S. PATENT DOCUMENTS

| | | | | |
|---|---|---|---|---|
| 3,474,703 | A | 10/1969 | Davis et al. | |
| 4,963,736 | A | 10/1990 | Douglas et al. | |
| 5,521,382 | A * | 5/1996 | Tanaka et al. | 250/292 |
| 5,652,427 | A | 7/1997 | Whitehouse et al. | |
| 5,708,268 | A * | 1/1998 | Franzen | 250/292 |
| 5,750,993 | A | 5/1998 | Bier | |
| 5,763,878 | A | 6/1998 | Franzen | |
| 5,847,386 | A | 12/1998 | Thomson et al. | |
| 5,852,294 | A | 12/1998 | Gulcicek et al. | |
| 6,194,717 | B1 * | 2/2001 | Hager | 250/292 |
| 6,285,027 | B1 * | 9/2001 | Chernushevich et al. | 250/287 |

OTHER PUBLICATIONS

Beu, et al. "Fourier–Transform Electrospray Instrumentation for Tandem High–Resolution Mass Spectrometry of Large Molecules" J Am Soc Mass Spectrom 1993, 4, 557–565.

De Biasi, Verner, et al. "High Troughput Liquid Chromatography/Mass Spectrometric Analyses Using a Novel Multiplexed Electrospray Interface," Rapid Commun. Mass Spectrometry, Apr. 28, 1999, 1165–1168, Issue 13, John Wiley & Sons.

Belov, et al. "Initial Implementation of an Electrodynamic Ion Funnel with Fourier Transform Ion Cyclotron Resonance Mass Spectrometry," J Am Soc Mass Spectrom 2000, 19–23, Issue 11, Elsevier Science Inc.

* cited by examiner

*Primary Examiner*—Jack Berman
(74) *Attorney, Agent, or Firm*—Ward & Olivo

(57) ABSTRACT

Disclosed is an ion guide for transferring ions from and ion source through vacuum regions in a mass spectrometer. The ion guide includes a housing with insulating holders provided to secure electrode rods of multiple devices in longitudinal alignment for the transmission of ions from the ion source to a mass analyzer. The device comprise a plurality of electrode rods each having at least one connecting leg. The rods are connected to the insulating holders via these connecting legs using connecting plates mounted on either side of and adjacent to each insulating border such that the connecting plates are in electrical contact with connecting legs. The connecting plates also have positioning groves to hold the connecting legs in position such that electrical contact is maintained between groups of the electrode rods.

37 Claims, 10 Drawing Sheets

MULTIPOLE ION GUIDE

FIELD OF THE INVENTION

The present invention relates generally to methods and devices for the transportation of ions through one or more pumping stages of a mass spectrometer. More specifically, an apparatus is described which facilitates the separation of neutral gas molecules from ions and passes the ions through one or more pumping stages or regions of a mass spectrometer. Further, the present invention may be used in an apparatus for selecting and/or transporting ions and charged droplets generated from an API source (e.g., Electrospray or Atmosphere Pressure Chemical Ionization, etc.) through a differential pumping region or regions for analysis in a mass spectrometer.

BACKGROUND OF THE PRESENT INVENTION

The present invention relates to multipole ion guides for use in mass spectrometry. The apparatus and methods for ionization described herein are enhancements of the techniques that are referred to in the literature relating to mass spectrometry.

Mass spectrometry plays an important role in the analysis of chemical compounds. Specifically, mass spectrometers are useful in determining the molecular weight of sample compounds. Analyzing samples using mass spectrometry consists of three steps—formation of gas phase ions from sample material, mass analysis of the ions to separate the ions from one another according to ion mass, and detection of the ions. Several methods exist in the field of mass spectrometry to perform each of these three functions. The certain combination of means used in a particular spectrometer determines that spectrometer's characteristics.

Mass analysis, for example, can be performed through magnetic (B) or electrostatic (E) analysis. Ions passing through a magnetic or electrostatic field follow a curved path. The path's curvature in a magnetic field indicates the momentum-to-charge ratio of the ion. In an electrostatic field, the curvature of the path will be indicative of the energy-to-charge ratio of the ion. Using magnetic and electrostatic analyzers consecutively determines the momentum-to-charge and energy-to-charge ratios of the ions, and the mass of the ion will thereby be determined. Other mass analyzers are the quadrupole (Q), the ion cyclotron resonance (ICR), the time-of-flight (TOF), and the quadrupole ion trap analyzers. The analyzer, which accepts ions from the ion guide described here, may be any of a variety of these.

Before mass analysis can begin, however, gas phase ions must be formed from sample material. If the sample material is sufficiently volatile, ions may be formed by electron ionization (EI) or chemical ionization (CI) of the gas phase sample molecules. For solid samples (e.g. semiconductors, or crystallized materials), ions can be formed by desorption and ionization of sample molecules by bombardment with high energy particles. Secondary ion mass spectrometry (SIMS), for example, uses keV ions to desorb and ionize sample material. In the SIMS process a large amount of energy is deposited in the analyte molecules. As a result, fragile molecules will be fragmented. This fragmentation is undesirable in that information regarding the original composition of the sample—e.g., the molecular weight of sample molecules—will be lost.

For more labile, fragile molecules, other ionization methods now exist. The plasma desorption (PD) technique was introduced by Macfarlane et al. in 1974 (Macfarlane, R. D.; Skowronski, R. P.; Torgerson, D. F., *Biochem. Biophys. Res Commoun.* 60 (1974) 616). Macfarlane et al. discovered that the impact of high energy (MeV) ions on a surface, like SIMS would cause desorption and ionization of small analyte molecules, however, unlike SIMS, the PD process results also in the desorption of larger, more labile species e.g., insulin and other protein molecules.

Lasers have been used in a similar manner to induce desorption of biological or other labile molecules. See, for example, VanBreeman, R. B.: Snow, M.: Cotter, R. J., *Int. J. Mass Spectrom. Ion Phys.* 49 (1983) 35; Tabet, J. C.; Cotter, R. J., *Anal. Chem.* 56 (1984) 1662; or Olthoff, J. K.; Lys, I.: Demirev, P.: Cotter, R.; *J., Anal. Instrument.* 16 (1987) 93. Cotter et al. modified a CVC 2000 time-of-flight mass spectrometer for infrared laser desorption of involatile biomolecules, using a Tachisto (Needham, Mass.) model 215G pulsed carbon dioxide laser. The plasma or laser desorption and ionization of labile molecules relies on the deposition of little or no energy in the analyte molecules of interest. The use of lasers to desorb and ionize labile molecules intact was enhanced by the introduction of matrix assisted laser desorption ionization (MALDI) (Tanaka, K.; Waki, H.; Ido, Y.; Akita, S.; Yoshida, Y.; Yoshica, T., *Rapid Commun. Mass Spectrom.* 2 (1988) 151 and Karas, M.; Hillenkamp, F., *Anal. Chem.* 60 (1988) 2299). In the MALDI process, an analyte is dissolved in a solid, organic matrix. Laser light of a wavelength that is absorbed by the solid matrix but not by the analyte is used to excite the sample. Thus, the matrix is excited directly by the laser, and the excited matrix sublimes into the gas phase carrying with it the analyte molecules. The analyte molecules are then ionized by proton, electron, or cation transfer from the matrix molecules to the analyte molecules. This process, MALDI, is typically used in conjunction with time-of-flight mass spectrometry (TOFMS) and can be used to measure the molecular weights of proteins in excess of 100,000 daltons.

Atmospheric pressure ionization (API) includes a number of methods. Typically, analyte ions are produced from liquid solution at atmospheric pressure. One of the more widely used methods, known as electrospray ionization (ESI), was first suggested by Dole et al. (M. Dole, L. L. Mack, R. L. Hines, R. C. Mobley, L. D. Ferguson, M. B. Alice, *J. Chem. Phys.* 49, 2240, 1968). In the electrospray technique, analyte is dissolved in a liquid solution and sprayed from a needle. The spray is induced by the application of a potential difference between the needle and a counter electrode. The spray results in the formation of fine, charged droplets of solution containing analyte molecules. In the gas phase, the solvent evaporates leaving behind charged, gas phase, analyte ions. Very large ions can be formed in this way. Ions as large as 1 MDa have been detected by ESI in conjunction with mass spectrometry (ESMS).

For example, FIG. 1 depicts a conventional mass spectrometer using an ESI ion source. Ions are produced from sample material in an ionization chamber 104. Sample solution enters the ionization chamber through a spray needle 105, at the end of which the solution is formed into a spray of fine droplets 111. The spray is formed as a result of an electrostatic field applied between the spray needle 105 and a sampling orifice 107. The sampling orifice may be an aperture, capillary, or other similar inlet leading into the vacuum chambers (101, 102 & 103) of the mass spectrometer. Electrosprayed droplets evaporate while in the ionization chamber thereby producing gas phase analyte ions. In addition, heated drying gas may be used to assist the evaporation of the droplets. Some of the analyte ions are carried with the gas from the ionization chamber 104 through the sampling orifice 107 and into the vacuum system (comprising vacuum chambers 101, 102 & 103) of the mass spectrometer. With the assistance of electrostatic lenses and/or prior art RF driven ion guides 109, ions pass through a differential pumping system (which includes vacuum chambers 101, 102 & 103 and lens/skimmer 108) before entering the high vacuum region 1 wherein the mass analyzer (not shown) resides. Once in the mass analyzer, the ions are mass analyzed to produce a mass spectrum.

Many other ion production methods might be used at atmospheric or elevated pressure. For example, MALDI has recently been adapted by Victor Laiko and Alma Burlingame to work at atmospheric pressure (Atmospheric Pressure Matrix Assisted Laser Desorption Ionization, poster #1121, $4^{th}$ International Symposium on Mass Spectrometry in the Health and Life Sciences, San Francisco, Aug. 25–29, 1998) and by Standing et al. at elevated pressures (Time of Flight Mass Spectrometry of Biomolecules with Orthogonal Injection+Collisional Cooling, poster #1272, $4^{th}$ International Symposium on Mass Spectrometry in the Health and Life Sciences, San Francisco, Aug. 25–29, 1998; and Orthogonal Injection TOFMS *Anal. Chem.* 71(13), 452A (1999)). The benefit of adapting ion sources in this manner is that the ion optics and mass spectral results are largely independent of the ion production method used.

An elevated pressure ion source always has an ion production region (wherein ions are produced) and an ion transfer region (wherein ions are transferred through differential pumping stages and into the mass analyzer). The ion production region is at an elevated pressure—most often atmospheric pressure—with respect to the analyzer. The ion production region will often include an ionization "chamber" (e.g. FIG. 1, ionization chamber 4). In an ESI source, for example, liquid samples are "sprayed" into the "chamber" to form ions.

Once the ions are produced, they must be transported to the vacuum for mass analysis. Generally, mass spectrometers (MS) operate in a vacuum between $10^{-4}$ and $10^{-10}$ torr depending on the type of mass analyzer used. In order for the gas phase ions to enter the mass analyzer, they must be separated from the background gas carrying the ions and transported through the single or multiple vacuum stages.

The use of multipole ion guides has been shown to be an effective means of transporting ions through vacuum. Publications by Olivers et al (Anal. Chem, Vol. 59, p. 1230–1232, 1987), Smith et al (Anal. Chem. Vol. 60, p. 436–441, 1988) and U.S. Pat. No. 4,963,736 (1990) have reported the use of an AC-only quadrupole ion guide to transport ions from an API source to a mass analyzer. A quadrupole ion guide operated in RF only mode, configured to transport ions is described by Douglas et al in U.S. Pat. No. 4,963,736. Multipole ion guides configured as collision cells are operated in RF only mode with a variable DC offset potential applied to all rods. Thomson et al, U.S. Pat. No. 5,847,386 describes a quadrupole configured to create a DC axial field along its axis to move ions axially through a collision cell, inter alia, or to promote dissociation of ions (i.e., by Collision Induced Dissociation (CID)).

Other schemes are available, which utilize both RF and DC potentials in order to facilitate the transmission of ions of a certain range of m/z values. For example, Morris et al., in H. R. Morris et al., High Sensitivity Collisionally-Activated Decomposition Tandem Mass Spectrometry on a Novel Quadrupole/Orthogonal—acceleration Time-of-Flight Mass Spectrometer, Rapid Commun. Mass Spectrom. 10, 889 (1996), uses a series of multipoles in their design, one of which is a quadrupole. The quadrupole can be run in a "wide bandpass" mode or a "narrow bandpass" mode. In the wide bandpass mode, an RF-only potential is applied to the quadrupole and ions of a relatively broad range of m/z values are transmitted. In narrow bandpass mode both RF and DC potentials are applied to the quadrupole such that ions of only a narrow range of m/z values are selected for transmission through the quadrupole. In subsequent multipoles the selected ions may be activated towards dissociation. In this way the instrument of Morris et al. is able to perform MS/MS with the first mass analysis and subsequent fragmentation occurring in what would otherwise be simply a set of multipole ion guides.

Ion guides similar to that of Whitehouse et al. U.S. Pat. No. 5,652,427 (1997), entitled Multipole Ion Guide for Mass Spectrometry, use multipole RF ion guides to transfer ions from one pressure region to another in a differentially pumped system. In the source of Whitehouse et al., ions are produced by ESI or APCI at substantially atmospheric pressure. These ions are transferred from atmospheric pressure to a first differential pumping region by the gas flow through a glass capillary. Ions are transferred from this first pumping region to a second pumping region through a "skimmer" by an electric field between these regions as well as gas flow. A multipole in the second differentially pumped region accepts ions of a selected mass/charge (m/z) ratio and guides them through a restriction and into a third differentially pumped region. This is accomplished by applying AC and DC voltages to the individual poles.

A four vacuum stage ES/MS quadrupole mass spectrometer instrument incorporating a multipole ion guide beginning in one vacuum pumping stage and extending contiguously into an adjacent pumping stage is depicted in FIG. 2. As discussed above, ions are formed from sample solution by an electrospray process when a potential is applied between sprayer 112 and sampling orifice 113. According to this prior art system shown in FIG. 2, a capillary is used to transport ions from the atmospheric pressure where the ions are formed to a first pumping region 114. Lenses 115, 116, and 117 are used to guide the ions from the exit of the capillary 118 to the mass analyzer 119 in the mass analysis region 120—in this case a quadrupole mass analyzer. Between lenses 115 and 117, an RF only hexapole ion guide 121 is used to guide ions through differential pumping stages 122 and 123 to exit 124 and into mass analysis region 120 through orifice 125. The hexapole ion guide 121, according to this prior art design, is intended to provide for the efficient transport of ions from one location—i.e. the entrance 126 of lens/skimmer 125—to a second location—i.e. exit 124. Further, through collisions with background (or collisional) gas in the hexapole, ions are cooled to thermal velocities.

In the scheme of Whitehouse et al., an RF only potential is applied to the multipole. As a result, the multipole is not "selective" but rather transmits ions over a broad range of mass-to-charge (m/z) ratios. Such a range as provided by a prior art multipoles is adequate for many applications, however, for some applications—particularly with MALDI—the ions produced may be well out of this range. High m/z ions such as are often produced by the MALDI ionization method are often out of the range of transmission of prior art multipoles.

Thus, electric voltages applied to the ion guide are conventionally used to transmit ions from an entrance end to and exit end. Analyte ions produced in the ion production region enter at the entrance end. Through collisions with gas in the ion guide, the kinetic energy of the ions is reduced to thermal energies. Simultaneously, the RF potential on the poles of the ion guide forces ions to the axis of the ion guide. Then, ions migrate through the ion guide toward its exit end.

In the Whitehouse patent, two or more ion guides in consecutive vacuum pumping stages are incorporated to allow different DC and RF values. However, losses in ion transmission efficiency may occur in the region of static voltage lenses between ion guides. A commercially available API/MS instrument manufactured by Hewlett Packard incorporates two skimmers and an ion guide. An interstage port (also called Drag stage) is used to pump the region between skimmers. That is, an additional pumping stage/region is added without the addition of an extra turbo pump, and therefore, better pumping efficiency can be achieved. In this dual skimmer design, there is no ion focusing device between skimmers, therefore ion losses may occur when gases are pumped away. Another commercially available API/MS instrument manufactured by Finnigan applies an electrical static lens between capillary and skimmer to focus the ion beam. Due to narrow mass range of the static lens, the instrument may need to scan the voltage to optimize the ion transmission.

SUMMARY OF THE INVENTION

An object of the present invention is to provide an improved multipole ion guide (i.e., quadrupole, hexapole, octapole, etc.) for use in mass spectrometry. More particularly, the present invention provides a multipole ion guide having pre-multipole and multipole guides. Pre-multipole guide is preferably a short (8–20 mm) guide which is used prior to a longer, main multipole and., preferably, between two skimmers (or other optical devices) separating wanted ions from unwanted neutral gas molecules.

In addition, it is an object of the invention to focus the ions toward the center axis of the ion guide while the neutral gas molecules are pumped away through an interstage port of the turbo pump. Efficient differential pumping allows the multipole to be positioned in a region having pressure low enough that ions can be trapped without significant scattering and still high enough to perform collisional cooling. Collisional cooling between ions and background gas can also effect the ion trajectory and ion kinetic energy. The background gas, through cooling the ions, aids in forming an ion beam with reduced energy spread. In some applications it may be desirable to trap the ions in the ion guide for a period of time. If the pressure in this region is too high, ions may be scattered away or fragmented. In a single skimmer system, the effects of this scattering are difficult to manage. In the present invention, though, the dual skimmer pre-multipole is short enough that ions are not trapped in this region. The short period of time spent in this region minimizes scattering and fragmentation. As a result, the ion guide of the invention results in efficient ion transport, increased resolution and sensitivity, and reduced energy spread.

Another object of the pre-multipole is to rapidly transfer ions through a first pressure region into a second, lower pressure region while maintaining a high transmission efficiency. Another object of the pre-multipole is to further cool the ions thereby reducing the ions' kinetic ions and focusing the ions. Yet another object of the pre-multipole is to provide for the removal of background (or collisional) gas prior to the mass analyzer—such gases may include nitrogen, oxygen, argon, helium, sulfur hexafluoride ($SF_6$), etc. Yet another object of the present invention is to provide a multipole ion guide to facilitate the transmission of ions into a mass spectrometer with minimal scattering and fragmentation of charged particles.

A variety of mass analyzers can be used with the present invention. Such analyzers which accept ions from the ion guide may be any of a variety of single, double, triple, etc., hybrid, hyphenated or non-hyphenated analyzers (e.g., time-of-flight mass analyzer (TOFMS), quadrupole mass spectrometer, quadrupole ion trap, Fourier transform ion cyclotron resonance mass analyzer (FT-ICRMS), ion mobility spectrometer (IMS), Fourier transform mass spectrometer (FTMS).

In one embodiment of the invention, ions and charged droplets generated from ESI or APCI along with neutral gas molecules pass through a capillary into the first pumping region. This region is pumped by a mechanical pump to a pressure of approximately 1–2 mbar. Optionally, the capillary exit and the first skimmer may have an electrical potential difference to push ions forward to the second skimmer while the neutral gas molecules are pumped away.

A second differential pumping region is pumped by the interstage port of a turbo molecular drag pump. The pressure in this region is between $1\times10^{-2}$ to $1\times10^{-1}$ mbar. The pre-multipole is preferably located between the first skimmer and the second skimmer in this region, and is preferably operated as RF only. It will separate charged ions from neutral gas molecules when those particles pass through the first skimmer and into the second it skimmer. The electrical field of this pre-multipole redirects ions and forces them to the center of the second skimmer. These ions can then pass through the opening of the second skimmer, while the neutral gas molecules, which are unaffected by the electric field, are pumped away.

Ions passing through the second skimmer enter the main multipole. The pressure in this third differential pumping region in $1\times10^{-3}$ to $1\times10^{-2}$ mbar. Neutral gas molecules in the third pumping region are pumped away through the main port of a turbo molecular drag pump. Collisional cooling of ions occurs inside the multipole. Cooled ions then enter the mass analyzer chamber for analysis.

A further object of the invention is to provide a multipole ion guide wherein the same potentials (amplitude and frequency) are applied to a pre-multipole guide and a main multipole guide. Alternatively, another object of the invention is to provide a multipole ion guide wherein the pre-multipole has different RF and DC potentials applied thereto than the main multipole (i.e., different amplitudes and/or frequencies) in order to improve ion transmission therethrough, as well as improve the mass selection range thereof.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

BRIEF DESCRIPTION OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which.

DETAILED DESCRIPTION OF THE PREFERRED EMBODIMENT

As required, a detailed illustrative embodiment of the present invention is disclosed herein. However, techniques, systems and operating structures in accordance with the present invention may be embodied in a wide variety of forms and modes, some of which may be quite different from those in the disclosed embodiment. Consequently, the specific structural and functional details disclosed herein are merely representative, yet in that me regard, they are deemed to afford the best embodiment for purposes of disclosure and to provide a basis for the claims herein which define the scope of the present invention. The following presents a detailed description of a preferred embodiment (as well as some alternative embodiments) of the present invention.

Figure 1:
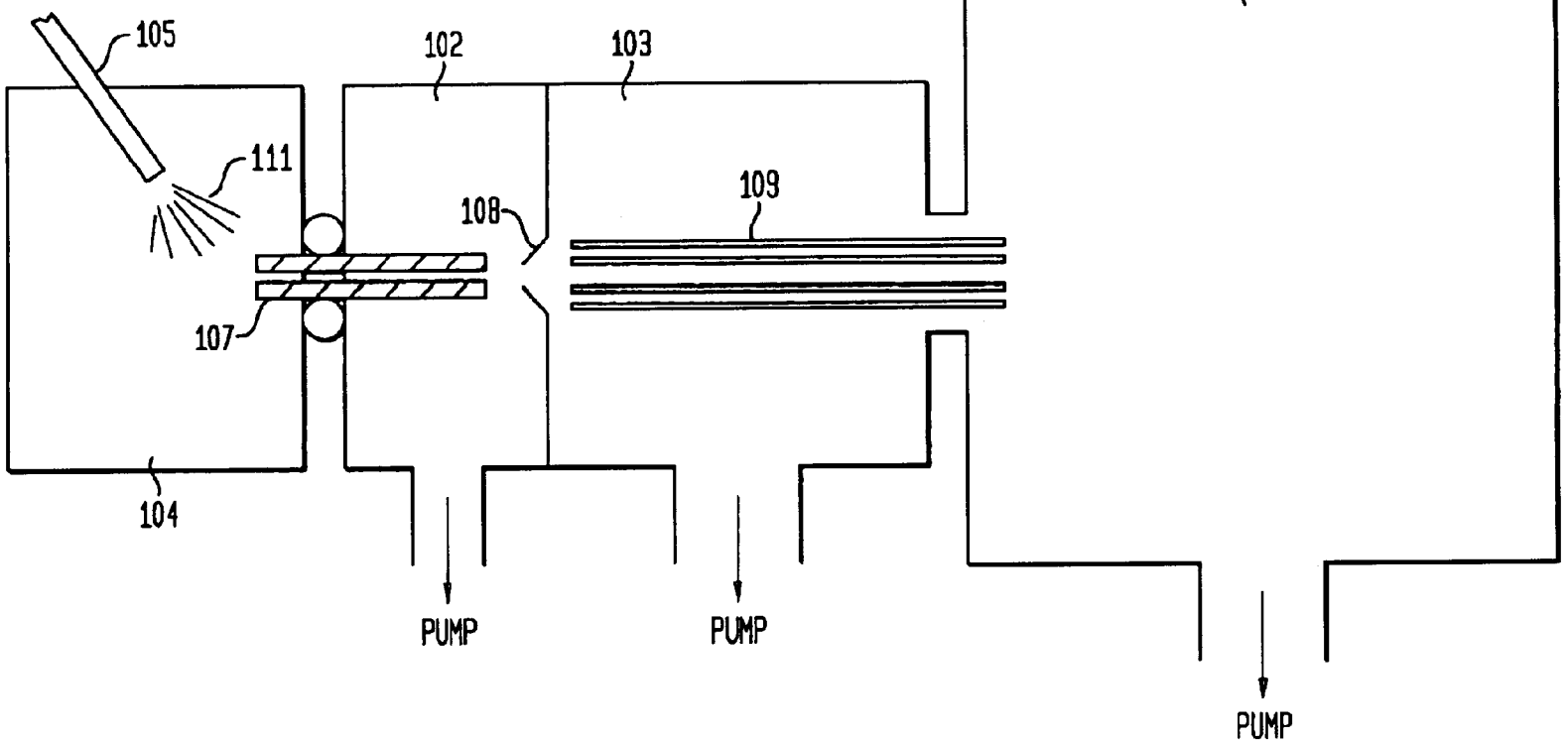
FIG. 1 (PRIOR ART)
FIG. 1 shows a conventional mass spectrometer having an ESI ion source.
Figure 2:
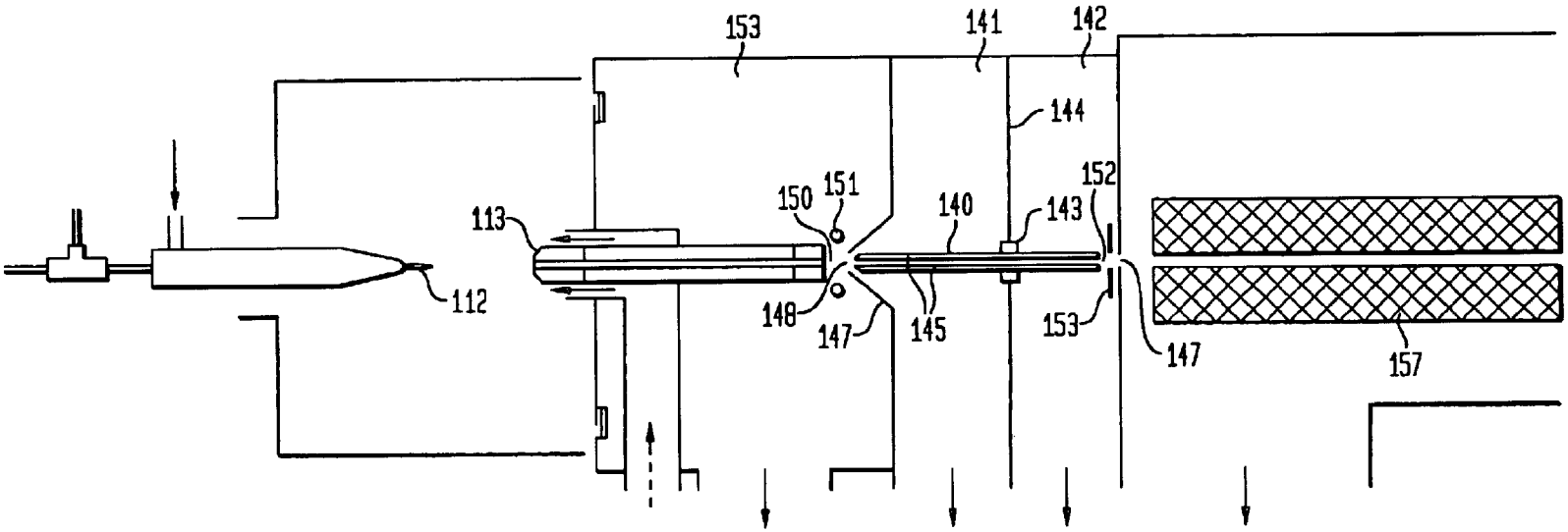
FIG. 2 (PRIOR ART)
FIG. 2 shows a four vacuum stage ES/MS quadrupole instrument with a multipole ion guide beginning in the second vacuum pumping stage and extending contiguously into the third pumping stage.
Figure 3:
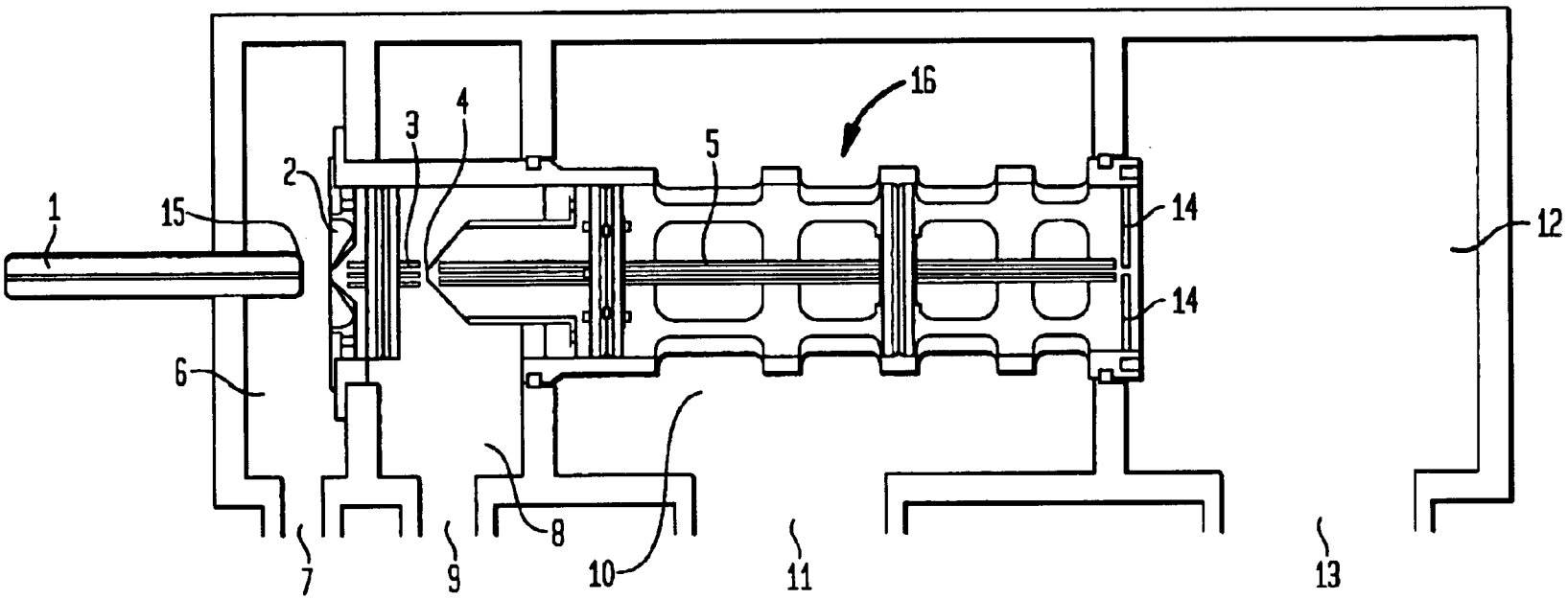
FIG. 3 shows a preferred embodiment of the multipole ion guide according to the invention as it is incorporated into a multiple stage pumping region of a mass spectrometer.

Referring first to FIG. 3, depicted is the preferred embodiment of multipole ion guide assembly 16 according to the invention as it is incorporated into a multiple stage pumping region of a mass spectrometer. Importantly, although the preferred embodiment of multipole ion guide assembly 16 is depicted as a hexapole, multipole ion guide assembly 16 may, of course, be a quadrupole, octapole, etc. Such a system, as shown in FIG. 3, includes multipole ion guide assembly 16, capillary 1, first, second and third differential pumping stages 6, 8 & 10, each of which being connected to a vacuum pump—roughing pump 7 and turbo pump having drag stage 9 & main stage 11, respectively, and mass analysis region 12, which is connected to a second turbo pump 13. Alternatively, a single pump or pumping system may be used in accordance with the invention.

Figure 4:
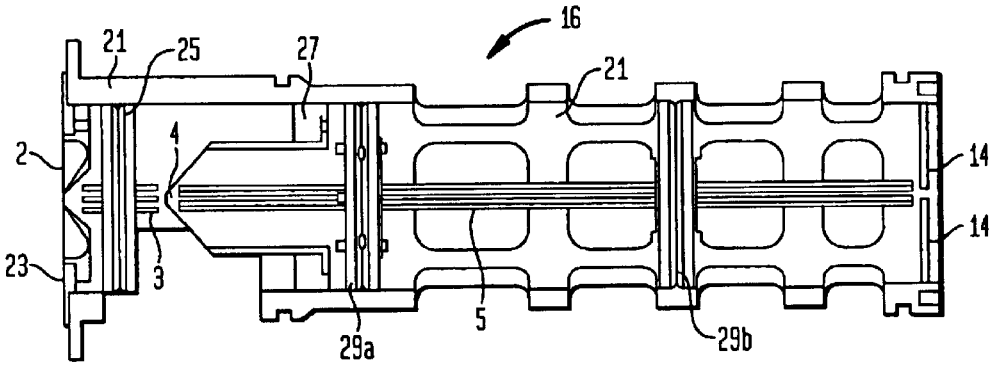
FIG. 4 shows a side view of a preferred embodiment of the multipole ion guide assembly according to the present invention.
Figure 5:
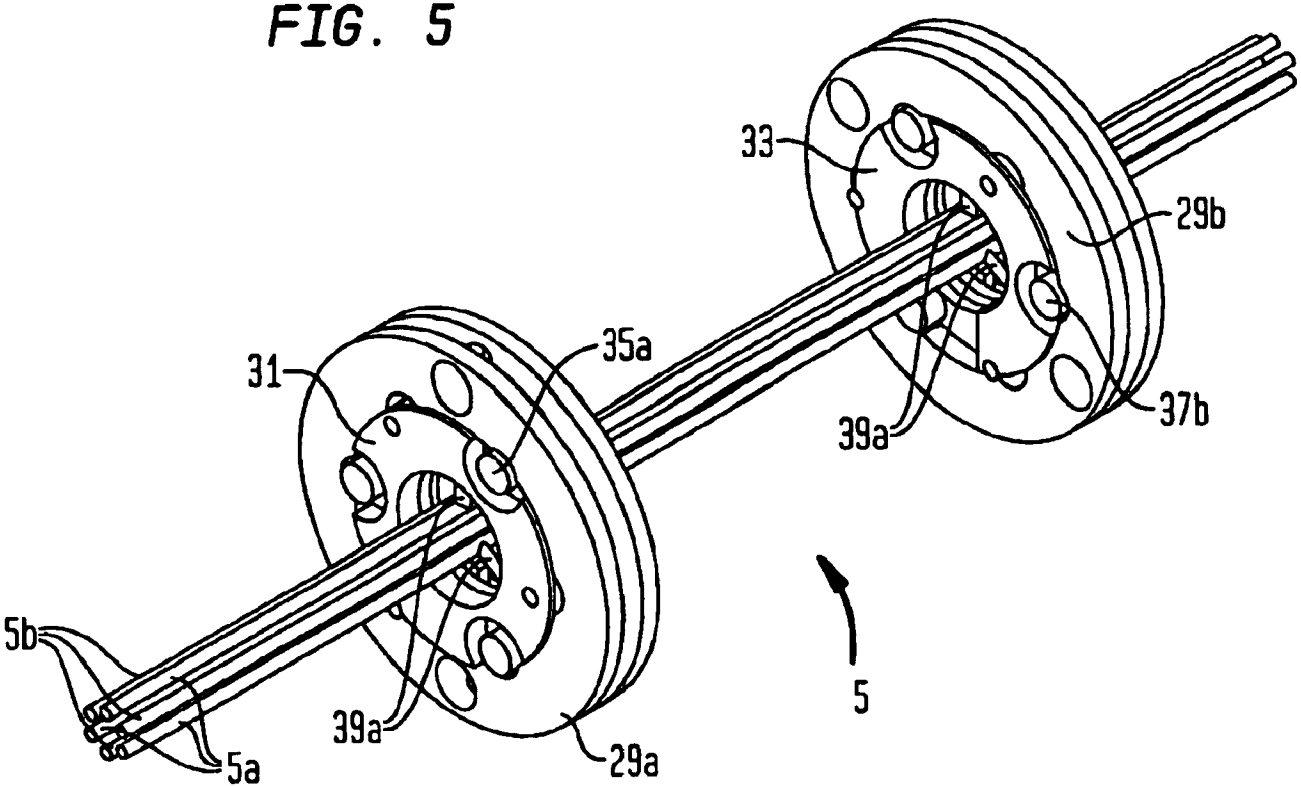
FIG. 5 shows a perspective view of a preferred embodiment of the electrode rods and insulating holders of the multipole ion guide depicted in FIG. 4.

Turning now to multipole ion guide assembly 16, as depicted in FIG. 4, a preferred embodiment of multipole ion guide assembly 16 comprises skimmers 2 & 4, pre-multipole 3, multipole 5, and exit electrodes 14. As shown, multipole ion guide assembly 16 is positioned such that it may transfer ions from a first pumping stage 6 to mass analysis region 12, across two other differential pumping stages (i.e., pumping stages 8 & 11). However, multipole ion guide assembly 16 may be used in systems with more or fewer pumping stages.

During operation, ions are generated from an API source (e.g., ESI or APCI) (not shown), and are introduced into first differential pumping stage 6 through an ion transport device such as capillary 1. First pumping stage 6 is preferably pumped to a pressure lower than atmospheric pressure by a vacuum pump connected via port 7. For example, this stage may preferably be pumped to a pressure of approximately 1–2 mbar. The transported ions enter first pumping stage 6 at capillary exit 15, whereupon an electric field directs the ions into first skimmer 2 of multipole ion guide assembly 16. The electric field may be generated by application of a potential difference across capillary exit 15 and first skimmer 2. This electric field is applied such that the ions are directed toward first skimmer 2, while neutral gas particles are pumped away. Optionally, this electric field may be varied depending on the desired result, the size of the ions being directed, the distance between capillary exit 15 and first skimmer 2, etc. Alternatively, it is envisioned that in certain situations better results may be obtained without application of an electric field across capillary exit 15 and first skimmer 2.

The ions that make it through skimmer 2 then enter second differential pumping stage 8, which is further pumped by a vacuum pump (e.g., a turbo molecular drag pump) via interstage port 9. Preferably, second pumping stage 8 is pumped and maintained at a pressure in the range from $1\times10^{-2}$ mbar to $1\times10^{-1}$ mbar. At this point, the surviving ions enter pre-multipole 3, preferably operated as an RF only ion guide, wherein the ions are further separated from any neutral gas molecules. As described in greater detail below, pre-multipole 3 comprises a plurality of electrode rods 4*a* & 4*b* (see FIGS. 9–10), each having a potential applied thereto such that the resulting electric field "pushes" or forces the ions toward a central axis as the ions continue to move through pre-multipole 3 toward skimmer 4 (leading to third pumping stage 10). This allows the ions to pass through second skimmer 4, while the neutral gas molecules, which are not affected by the electrical field, are pumped away. Preferably, pre-multipole 3 is positioned between a first skimmer 2 and a second skimmer 4, pre-multipole 3 being located entirely in second differential pumping stage 8. Of course, alternative configurations may be used. For example, pre-multipole 3 may be positioned to cross from one pumping stage to another, one or both skimmers may be removed, or one or both skimmers may be replaced with focusing lenses (e.g., Einsel lenses, etc.).

As ions pass through second skimmer 4, they enter third pumping stage 10 and multipole 5. Preferably, third pumping stage 10 is pumped to and maintained at a pressure in the range from $1\times10^{-3}$ mbar to $1\times10^{-2}$ mbar. At this point, the surviving ions enter multipole 5, preferably operated as an RF only ion guide, wherein the ions are further separated from any neutral gas molecules. As described in greater detail below, multipole 5 comprises a plurality of electrodes 5*a* & 5*b* (see FIGS. 5–7B), each having an electric potential applied thereto such that the resulting electric field "pushes" or forces the ions toward a central axis of multipole 5. Again, application of the electric field separates the ions from other neutral gas molecules present (which are pumped away because they are not affected by the electrical field). That is, neutral gas molecules will be continuously pumped away through port 11 by the connected pump (not shown) (e.g., a turbo molecular drag pump). In addition, the introduction or presence of collisional gas in third pumping stage 10 results in the collisional cooling of the ions within multipole 5 as the ions are being "guided" therethrough. The cooled ions are then introduced into mass analysis region 12 for subsequent mass analysis. Mass analysis region 12 may comprise any of a number of mass analysis devices, including but not limited to time-of-flight (TOF), quadrupole (Q), Fourier transform ion cyclotron resonance (FTICR), ion trap, magnetic (B), or electrostatic (E), ion cyclotron resonance (ICR), or quadrupole ion trap analyzers.

In a preferred embodiment of the invention, multipole 5 is positioned between second skimmer 4 and exit electrodes 14 (which lead to mass analysis stage 12), multipole 5 being entirely positioned within third pumping stage 10. Of course, alternative configurations may be used, which include, for example, multipole 5 being positioned across multiple pumping stages, skimmer 4 or exit electrodes 14 may be removed or replaced by other elements such as focusing lenses (e.g., Einsel lenses, etc.).

Preferably, multipole ion guide assembly 16 includes pre-multipole 3 comprising short (e.g., 8–20 mm) electrodes between first and second skimmers (2 & 4, respectively) to separate the ions from any existing neutral gas molecules prior to the ions entering multipole 5. In addition, pre-multipole 3 may focus ions onto the center of second skimmer 4 while the neutral gas molecules are pumped away. Efficient differential pumping in the pumping stages (6, 8 & 10) allows multipole 5 (the main ion guide) to be in a pressure region having a pressure which is both low enough for ion trapping and high enough for collisional cooling. The ion guide of the present invention may be used in applications requiring either ion trapping (for a specific period of time), ion selecting, ion fragmenting, etc. For instance, if the pressure in the region containing multipole 5 is too high, ions may be scattered or fragmented. In a single skimmer system, the effects of this scattering or fragmenting are difficult to manage. Conversely, in the present invention, the presence of more than one skimmer with pre-multipole 3 being short enough so that ions are not trapped in this region minimizes scattering and fragmentation of the sample ions.

Turning next to FIG. 4, shown is an internal side view of a preferred embodiment of multipole ion guide assembly 16 according to the present invention. As shown, a preferred embodiment of multipole ion guide assembly 16 comprises housing 21 in which first skimmer 2 and its insulating holder 23, second skimmer 4 and its insulating holder 27, pre-multipole 3 and its insulating holder 25, multipole 5 and its insulating holders 29*a* & 29*b*, and exit electrodes 14 are all secured in longitudinal alignment. These ion optic elements are all maintained in longitudinal alignment with each other such that ions may be transported on a single axis through each optical component of multipole ion guide assembly 16 from the ion source to the mass analyzer. Preferably, housing 21 is made from a rigid and durable material, such as aluminum.

Preferably, skimmer 2 is secured by insulating holder 23 to housing 21 at a first end (the entrance end) of multipole ion guide assembly 16. Insulating holder 23 provides skimmer with electrical insulation from housing 21 and the other optical components of multipole ion guide assembly 16. Similarly, skimmer 4 is secured to housing 21 (being positioned between pre-multipole 3 and multipole 5) via insulating holder 27, where insulating holder 27 provides electrical insulation for skimmer 4 from housing 21 and the other optical components of multipole ion guide assembly 16.

Pre-multipole 3 is also preferably electrically insulated 174 from housing 21 and the other optical components of multipole ion guide assembly 16 by insulating holder 25, which also positions pre-multipole 3 in longitudinal alignment between skimmers 2 & 4. Similarly, multipole 5 is preferably electrically insulated from housing 21 and the other optical components of multipole ion guide assembly 16 by insulating holders 29*a* & 29*b*, which also position multipole 5 in longitudinal alignment between skimmer 4 and exit electrodes 14.

In a preferred operation of multipole ion guide assembly 16 shown in FIG. 4, sample ions are first introduced into and through skimmer 2 (as discussed above) so they enter first pumping stage 6 (see FIG. 3) and pre-multipole 3. In pre-multipole 3, the ions are separated from any existing neutral gas molecules, and are transported longitudinally therethrough. That is, an electric field, which is generated through the application of potentials to the rods of pre-multipole 3, forces the ions towards the center axis of pre-multipole 3 as the ions move longitudinally therethrough. The electric field has no effect on the neutral gas molecules, such that substantially all of these molecules are not transported through or directed through pre-multipole 3.

Once transported through pre-multipole 3, the sample ions are introduced into and through skimmer 4 (as discussed above) so they enter second pumping stage 8 (see FIG. 3) and multipole 5. In multipole 5, the ions are further separated from any existing neutral gas molecules, are trapped, collisionally cooled, selected, fragmented, scattered, etc. (as discussed above), and are transported longitudinally therethrough. At the exit of multipole 5, the selected (or fragmented, etc.) sample ions pass through exit electrodes 14 where the ions are accelerated into a mass analyzer for subsequent analysis.

In a preferred embodiment of multipole ion guide assembly 16, as shown in FIG. 4, it is important that insulating holders 23, 25, 27, 29*a* & 29*b*, as well as insulating housing 21 maintain the electrical independence of skimmer 2, pre-multipole 3, skimmer 4, multipole 5, and exit electrodes 14, even though such components are secured in longitudinal alignment within housing 21. For instance, individual components, and also individual elements within the individual components, may require application of separate and/or different electrical potentials for optimum performance. Therefore, it is preferred that the electrical independence of each component is maintained. However, in an alternative embodiment certain components (i.e., skimmer 2 and skimmer 4) of multipole ion guide assembly 16 may be in electrical contact with one another such that the same electric potentials may be applied to each.

Figure 6:
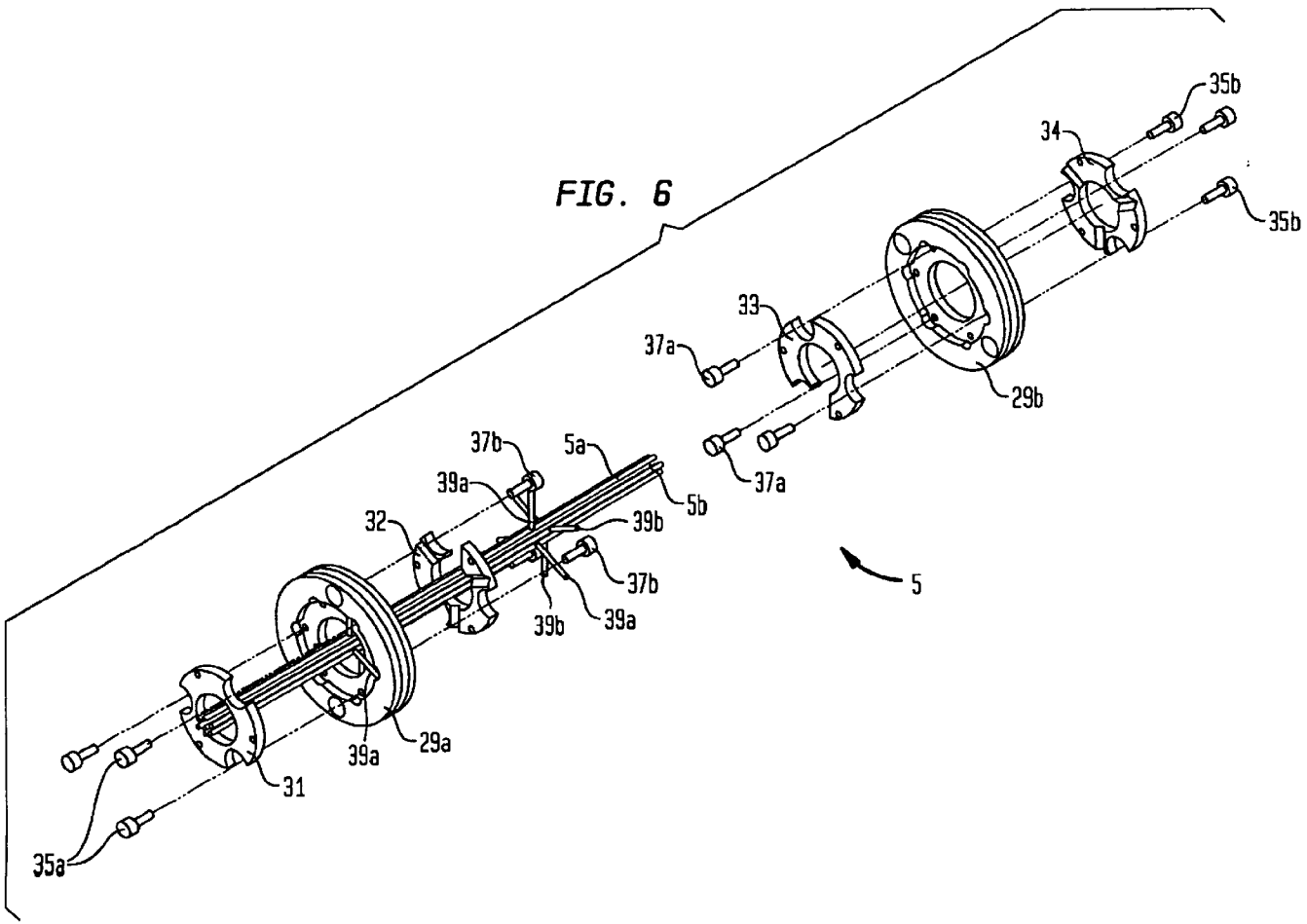
FIG. 6 shows a partial exploded perspective view of a preferred embodiment of the electrode rods and insulating holders of the multipole ion guide depicted in FIGS. 3–5.

Referring now to FIGS. 5, 6, 7A and 7B, shown is a perspective view of the preferred embodiment of multipole 5 and its components, as depicted in FIGS. 3 & 4. Initially, as shown in FIG. 6, multipole 5 comprises electrode rods 5*a* & 5*b* (each electrode rod 5*a* & 5*b* having at least one connecting leg 39*a* & 39*b*, respectively) and insulating holders 29*a* & 29*b*. Preferably, each electrode rod 5*a* or 5*b* has as many connecting legs 39*a* & 39*b* as there are insulating holders 29*a* & 29*b*. Electrode rods 5*a* & 5*b* are preferably positioned parallel and equidistant from one another, as well as equidistant from a central axis, and are attached to insulating holders 29*a* & 29*b* at each connecting leg 39*a* & 39*b*. Alternatively, electrode rods 5*a* & 5*b* may be configured such that all electrode rods are not equidistant from each other or not equidistant from a central axis. For example, electrode rods 5*a* may all be positioned at a first distance from the central axis of multipole 5, while electrode rods 5*b* may all be positioned at a second distance from the same central axis of multipole 5.

Also as shown in FIG. 6, electrode rods 5*a* & 5*b* are connected to insulating holders 29*a* & 29*b* via connecting legs 39*a* & 39*b*. To accomplish this connection, insulating holder 29*a* further comprises a first and second connecting plates 31 & 32, respectively, mounted on either side of and adjacent to insulating holder 29*a* and secured by screws 35*a* & 37*b*. Importantly, screws 35*a* & 37*b* hold first and second connecting plates 31 & 32 in electrical contact with a first set of connecting legs 39*a* & 39*b*. Similarly, insulating holder 29*b* further comprises a first and second connecting plates 33 & 34, respectively, mounted on either side of and adjacent to insulating holder 29*b* and secured by screws 37*a* & 35*b*. Once again, screws 37*a* & 35*b* hold first and second connecting plates 33 & 34 in electrical contact with a second set of connecting legs 39*a* & 39*b*. Thus, electrode rods 5*a* having connecting legs 39*a*, and first connecting plates 31 & 33 secured to insulating holders 29*a* & 29*b* by screws 35*a* & 37*a*, respectively, are all maintained in electrical contact. Similarly, electrode rods 5*b* having connecting legs 39*b*, and first connecting plates 32 & 34 secured to insulating holders 29*a* & 29*b* by screws 37*b* & 35*b*, respectively, are all maintained in electrical contact. Because the structure of multipole 5 is as described, any requisite electric field can be generated through the application of two electric potentials—one to electrode rods 5*a* and another to electrode rods 5*b*.

Figure 7A:
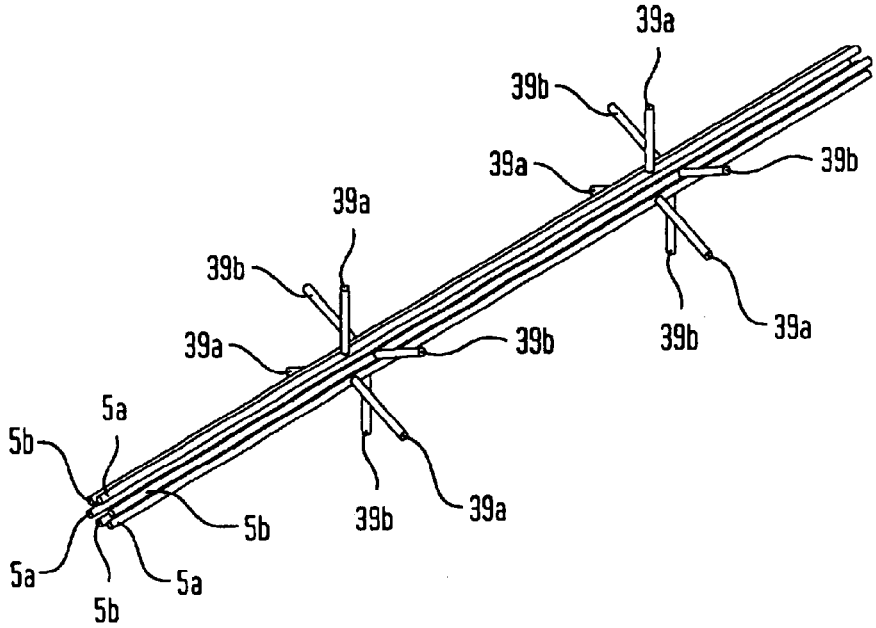
FIG. 7A shows a perspective view of a preferred embodiment of the electrode rods of the multipole ion guide depicted in FIGS. 3–6.
Figure 7B:
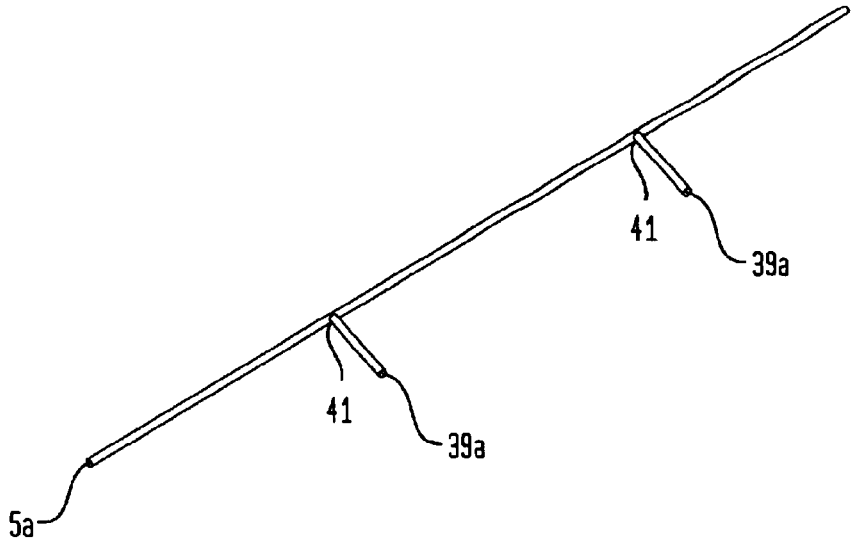
FIG. 7B shows a perspective view of a preferred embodiment of a single electrode rod of the multipole ion guide depicted in FIG. 7A.

Turning next to FIGS. 7A and 7B, shown are perspective views of a preferred embodiment of electrode rods 5*a* & 5*b* (FIG. 7A) of multipole 5 configured hexagonally (i.e., a hexapole), and of a single electrode rod 5*a* of multipole 5. As depicted, electrode rods 5*a* & 5*b* are positioned such that no two electrode rods 5*a* are adjacent to one another and no two electrode rods 5*b* are adjacent to one another. This allows the appropriate electric field to be generated within multipole 5 such that sample ions are forced to the center of multipole 5 as they pass therethrough.

Also, as shown in FIG. 7A, a preferred embodiment of a multipole 5 comprises six electrode rods 5*a* & 5*b*—three electrode rods 5*a* and three electrode rods 5*b*. Of course, multipole 5 may comprise four, eight, ten, etc., electrode rods (i.e., in quadrupole, octapole, etc.), depending upon the application to which multipole 5 is put. In addition, multipole 5 may comprise three, five, seven, etc., electrode rods, again depending on the particular application multipole 5 is used in conjunction with, and depending on the desired electric field to be applied to the sample ions. As shown, each electrode rod 5*a* includes a pair of connecting legs 39*a*, which are in electrical contact with at least one of first connecting plates 31 or 33 (see FIG. 6) such that all of electrode rods 5*a* are in electrical contact with one another, but not in electrical contact with any of the adjacent electrodes 5*b*. Similarly, each electrode rod 5*b* includes a pair of connecting legs 39*b*, which are in electrical contact with at least one of first connecting plates 32 or 34 (see FIG. 6) such that all of electrode rods 5*b* are in electrical contact with one another, but not in electrical contact with any of the adjacent electrodes 5*a*.

Referring specifically to FIG. 7B, a single electrode rod 5*a* of multipole 5 is shown having connecting legs 39*a* (the remaining electrode rods 5*a* have the same structure as the one depicted). Electrode rods 5*b* are similar in structure, but the position of connecting legs 39*b* varies slightly from the position of connecting legs 39*a* in order to the maintain electrical independence between electrode rods 5*a* and rods 5*b* (see FIG. 7A). As shown, connecting legs 39*a* preferably extend perpendicularly from electrode rod 5*a* for easy connection to insulating holders 29*a* & 29*b* and connecting plates 31, 32, 33 & 34 (see FIG. 6). Of course, other angles of orientation may be used. Connecting legs 39*a* & 39*b* (not shown) may be laser welded on electrode rods 5*a* & 5*b* at joints 41. However, any other known means for joining metal components to maintain electrical conductivity can be used. In addition, in the shown preferred embodiment all connecting legs 39*a* & 39*b* have the same length, although in alternative embodiments the lengths of connecting legs 39*a* & 3*b* may vary depending on the configuration of insulating holders 29*a* & 29*b* and first and second connecting plates 31, 32, 33 & 34.

Figure 8:
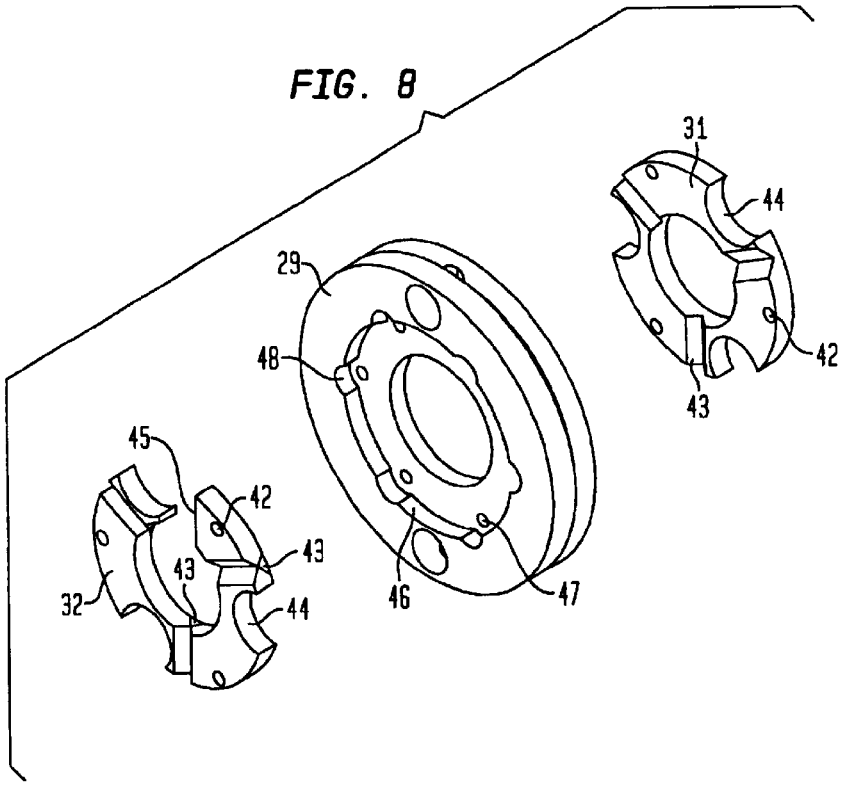
FIG. 8 shows an exploded perspective view of a preferred embodiment of the insulating holder and mounting disks for the multipole ion guide depicted in FIGS. 3–7B.

In a preferred embodiment, insulating holders 29*a* & 29*b*, and first and second connecting plates 31, 32, 33 & 34 are comprised as shown in FIG. 8 (only insulating holder 29*a*, and first and second connecting plates 31 & 32 are shown, but in the preferred embodiment shown and described herein, insulating holder 29*b*, and first and second connecting plates 33 & 34 are identical). Preferably, each of first and second connecting plates 31 & 32 include three threaded through holes 42 for attachment to insulating holder 29*a* via screws 37*b* & 35*a*, respectively. Insulating holder 29*a* preferably includes six through holes 47, preferably not threaded, and six arch-shaped cut-outs 48, such that screws 35*a* & 37*b* may pass therethrough to interconnect with opposite connecting plates 32 & 31, respectively. In addition, each side of insulating holder 29*a* has a cut-out section 46 having a configuration similar to the general size and shape of connecting plates 31 & 32, such that each connecting plate 31 & 32 may be positioned therein. Preferably, the depth of this cut-out portion on either side of insulating holder 29*a* is approximately the same as the thickness of each connecting plate, so that when positioned together, the outer surfaces of insulating holder 29*a* with connecting plates 31 & 32 is smooth.

Also, connecting plates 31 & 32 preferably have arch-shaped cutouts in order that the heads of screws 35*a* & 37*b* do not come into electrical contact therewith. Since insulating holder 29*a* is not conductive, electrical independence between connecting plates 31 & 32 (and therefore electrode rods 5*a* & 5*b*) is maintained. Finally, first and second connecting plates 31 & 32 also have three positioning groves 43. Once assembled, positioning grooves hold connecting legs 39*a* & 39*b* in position such that electrical contact is maintained between all of electrode rods 5*a*, and similarly between all of electrode rods 5*b*. Additionally, connecting plate 32 comprises cut-out (or opening) 45 to aid in the assembly of the ion guide according to the invention.

Figure 9:
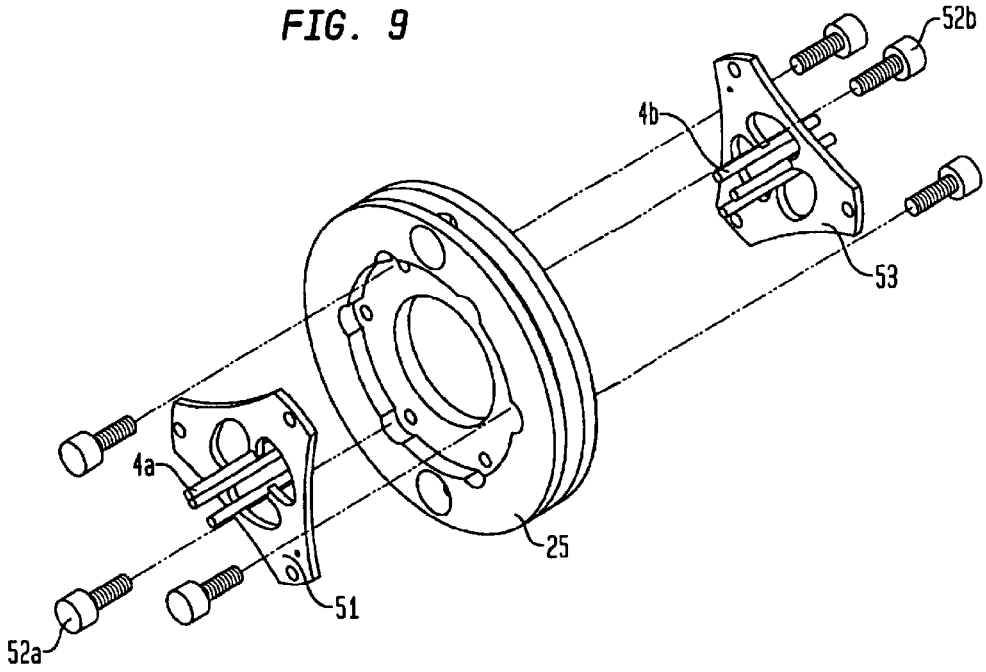
FIG. 9 shows an exploded perspective view of a preferred embodiment of the pre-multipole ion guide depicted in FIGS. 3–4.
Figure 10:
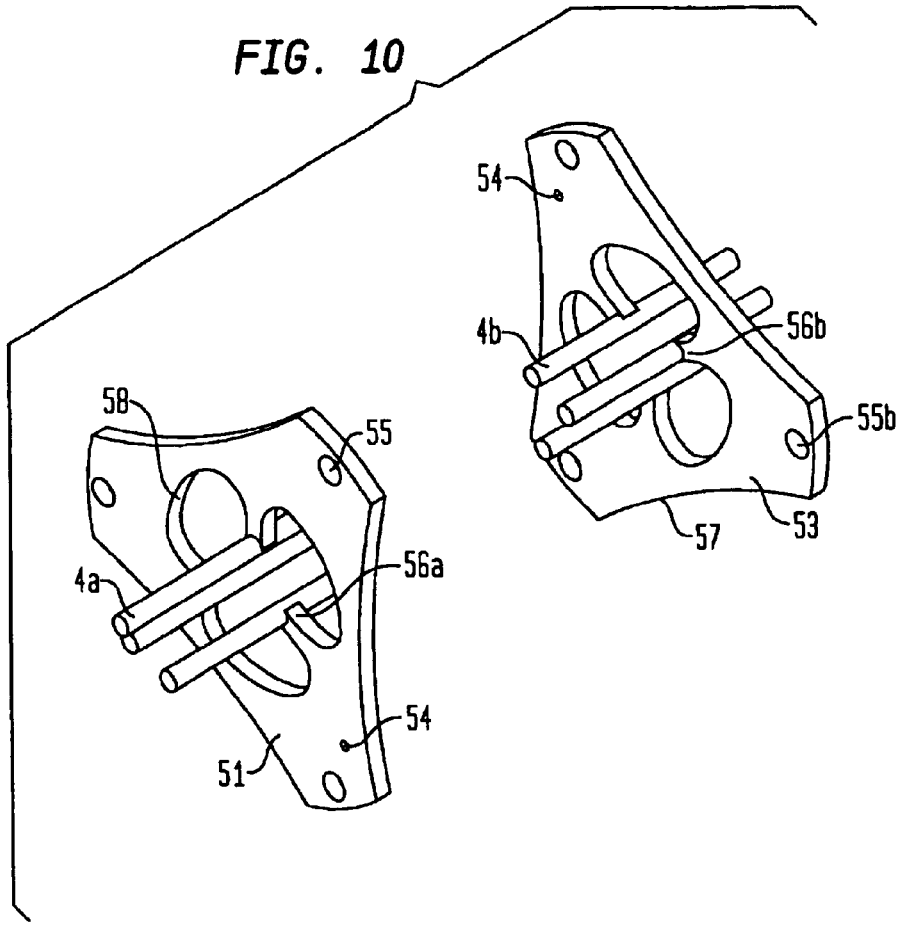
FIG. 10 shows an enlarged perspective view of a preferred embodiment of the mounted electrode rods for the pre-multipole ion guide depicted in FIG. 9.

Turning now to FIGS. 9 & 10, shown are exploded perspective views of a preferred embodiment of pre-multipole 3, which demonstrates the assembly of pre-multipole 3. FIG. 10 specifically shows an enlarged perspective view of the preferred connecting plates 51 & 53 of pre-multipole 3. Initially, as shown in FIG. 9, pre-multipole 3 comprises electrode rods 4*a* & 4*b*, connected to first and second connecting plates 51 & 53, respectively, at connections 56, insulating holder 25, and screws 52 & 52*b*. Electrode rods 4*a* & 4*b* are preferably positioned parallel and equidistant from one another, as well as equidistant from a central axis, and are attached to insulating holders 25 at connection 56. Alternatively, electrode rods 4*a* & 4*b* (similar to electrode rods 5*a* & 5*b*) may be configured such that all electrode rods are not equidistant from each other or not equidistant from a central axis. For example, electrode rods 4*a* may all be positioned at a first distance from the central axis of pre-multipole 3, while electrode rods 4*b* may all be positioned at a second distance from the same central axis of pre-multipole 3.

Also, as shown in FIGS. 9 & 10, connecting plate 51 comprises connections 56*a* such that electrode rods 4*a* are affixed directly to, and are in electrical contact with, connecting plate 51. Preferably, electrode rods 4*a* are laser welded to connecting plate 51 at connections 56*a*. However, other known means for joining metal components to maintain electrical conductivity may be used to form connections 56*a*. Similarly, connecting plate 53 comprises connections 56*b* such that electrode rods 4*b* are affixed directly to, and are in electrical contact with, connecting plate 53. Preferably, electrode rods 4*b* are laser welded to connecting plate 53 at connections 56*b*. However, other known means for joining metal components to maintain electrical contact may be used to form connections 56*b*.

First and second connecting plates 51 & 53 are mounted on either side of insulating holder 25 and secured by screws 52*a* & 52*b*. Importantly, screws 52*a* & 52*b* hold first and second connecting plates 51 & 53 in place within cut-out portions on either side of insulating holder 25 such that each of electrode rods 4*a* & 4*b* are maintained in parallel and equidistant from one another and from a central axis.

Referring specifically to FIG. 10, connecting plates 51 & 53 are configured to have internal openings 58 and external cuts 57 such that no electric contact occurs between electrode rods 4*a* and electrode rods 4*b* when secured to insulating holder 25 via screws 52*a* & 52*b*—thereby enabling achievement of the desired electric field within pre-multipole 3. Finally, connecting plates 51 & 53 preferably include threaded through holes 55*a* & 55*b* into which screws 52*a* & 52*b* are threaded for attachment of connecting plates 51 & 53 to insulating holder 25. Of course, connecting plates 51 & 53 may be configured in a number of other shapes and sizes, and the one shown is merely representative of one embodiment for a pre-multipole having six electrode rods (i.e., a hexapole). Others may comprise four, eight, etc., electrode rods (i.e., quadrupole, octapole, etc.), which may require alternative connecting plate configurations. Moreover, as shown in FIG. 10, connecting plates 51 & 53 may optionally comprise identifying hole 54 to identify the orientation of connecting plate 51 & 53 during assembly.

While the present invention has been described with reference to one or more preferred embodiments, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. An apparatus for selecting and/or transporting ions from an ion source to a mass analyzer, said apparatus comprising:

a first multipole including a plurality of first electrode rods removably secured in longitudinal alignment by at least one first insulating holder;

a second multipole including a plurality of second electrode rods removably secured in longitudinal alignment by at least one second insulating holder; and a housing for securing said first and second multipoles in longitudinal alignment, said housing being removably positioned within a vacuum region of a mass spectrometer;

wherein said insulating holders have at least one longitudinal bore therethrough for positioning each of said electrode rods in parallel alignment such that said electrode rods are positioned equidistant from the central axis of said longitudinal bore.

2. An apparatus according to claim 1, wherein said first multipole is operated as an RF only ion guide.

3. An apparatus according to claim 1, wherein said first multipole is positioned entirely within a single vacuum region of said mass spectrometer.

4. An apparatus according to claim 1, wherein an entrance end of said first multipole is positioned in a first vacuum region and an exit end of said first multipole is positioned in a second vacuum region.

5. An apparatus according to claim 1, wherein said second multipole is operated as an RF only ion guide.

6. An apparatus according to claim 1, wherein said second multipole is positioned entirely within a single vacuum region of said mass spectrometer.

7. An apparatus according to claim 1, wherein an entrance end of said second multipole is positioned in a first vacuum region and an exit end of said second multipole is positioned in a second vacuum region.

8. An apparatus according to claim 1, wherein said first electrode rods have lengths in the range of 8–20 millimeters.

9. An apparatus according to claim 1, wherein said mass analyzer is selected from the group consisting of a time-of-flight mass analyzer, a quadrupole mass analyzer, a Fourier transform mass analyzer, a ion cyclotron resonance mass analyzer, a magnetic sector mass analyzer, a electrostatic sector mass analyzer and a quadrupole ion trap mass analyzer.

10. An apparatus according to claim 1, wherein each said first electrode rods are positioned at a first distance from the central axis of said longitudinal bore, and each said second electrode rods are positioned at a second distance from the central axis of said longitudinal bore.

11. An apparatus according to claim 1, wherein said first and second multipoles include an even number of said rods.

12. An apparatus according to claim 1, wherein said first and second multipoles include an odd number of said rods.

13. An apparatus according to claim 1, wherein each of said first and second electrode rods includes at least one connector for removable attachment to said insulating holders.

14. An apparatus according to claim 13, wherein said insulating holders have a first side and a second side such that said connectors are removably attached to said insulating holders on either said first side or said second side.

15. An apparatus according to claim 13, wherein said connectors are positioned approximately perpendicular to said rods.

16. An apparatus according to claim 13, wherein said connectors are integrally formed with said rods.

17. An apparatus for transferring ions from an ion source through one or more differential pumping regions in a mass spectrometer, said apparatus comprising:

first and second multipole devices secured in longitudinal alignment within a housing;

a plurality of insulating holders for maintaining said longitudinal alignment of said multipole devices; and at least one restriction means for allowing said first multipole device to be positioned within said housing in a first pumping region and said second multipole device to be positioned within said housing in a second pumping region;

wherein said multipole devices each comprise a plurality of electrode rods having connecting elements, and one or more connecting plates having longitudinal bores therethrough; and wherein each of said rods is removably positioned within said longitudinal bore of said connecting plates such that said connecting elements are removably secured within said insulating holders.

18. An apparatus according to claim 17, wherein said rods are positioned equidistant from one another.

19. An apparatus according to claim 17, wherein said rods are positioned equidistant from a central axis of said longitudinal bores.

20. An apparatus according to claim 17, wherein a first group of said rods are positioned at a first distance from a central axis of said longitudinal bores and a second group of said rods are positioned at a second distance from said longitudinal bores such that application of an electric potential between said first group and said second group of said rods produces an electric field.

21. An apparatus according to claim 17, wherein said rods and said connecting plates are in electrical contact through said connecting elements.

22. An apparatus according to claim 17, wherein said rods are positioned around a central axis of said longitudinal bores such that electric potentials are applied to a plurality of groups of said rods positioned at varying distances from said central axis to produce an electric field for forcing said ions toward said central axis.

23. An apparatus according to claim 22, wherein said longitudinal alignment of said multipole devices provides optimum electrical independence of each of said devices through application of separate electrical potentials to said rods of each of said devices.

24. An apparatus according to claim 17, wherein said insulating holders each have a first and second side with means for positioning one or more of said connecting elements, and where one or more of said connecting plates are attached to at least one of a said first or second side of said insulating holders such that said connecting plates are in electrical contact with one or more of said connecting elements.

25. An apparatus according to claim 17, wherein said restriction means is a skimmer.

26. An apparatus according to claim 17, wherein said restriction means is a focusing lens.

27. An apparatus according to claim 17, wherein at least one of said multipole devices is positioned such that an entrance end is in said first pumping region and an exit end is in said second pumping region.

28. An apparatus according to claim 17, wherein one of said multipole devices is operated as an RF only ion guide.

29. An apparatus according to claim 17, wherein at least one of said multipole devices is positioned entirely within said first or said second pumping region.

30. An apparatus according to claim 17, wherein said electrode rods of at least on of said multipole devices have lengths in the range of 8–20 millimeters.

31. An apparatus according to claim 17, wherein said apparatus is used to transfer ions to a mass analyzer.

32. An apparatus according to claim 31, wherein said mass analyzer is selected from the group consisting of a time-of-flight mass analyzer, a quadrupole mass analyzer, a Fourier transform mass analyzer, a ion cyclotron resonance mass analyzer, a magnetic sector mass analyzer, a electrostatic sector mass analyzer and a quadrupole ion trap mass analyzer.

33. An apparatus according to claim 17, wherein said multipole devices include an even number of said rods.

34. An apparatus according to claim 17, wherein said multipole devices include an odd number of said rods.

35. An apparatus according to claim 17, wherein said insulating holders have a first side and a second side such that said connectors are removably attached to said insulating holders on either said first side or said second side.

36. An apparatus according to claim 17, wherein said connecting elements are positioned approximately perpendicular to said rods.

37. An apparatus according to claim 17, wherein said connecting elements arm integrally formed with said rods.

* * * * *